United States Patent [19]

Diersing

[11] 3,978,631

[45] Sept. 7, 1976

[54] DISPLAY UNITS WITH SOCKET-MOUNTED STANDARDS

[75] Inventor: Warren H. Diersing, Lincoln, Ill.

[73] Assignee: Myers Industries, Inc., Lincoln, Ill.

[22] Filed: Aug. 4, 1975

[21] Appl. No.: 601,796

[52] U.S. Cl. ..... 52/239; 52/280; 52/760; 40/125 H; 40/152.1

[51] Int. Cl.[2] ..... E04H 1/00; E04H 3/00

[58] Field of Search ..... 52/239, 241, 481, 70, 52/64, 238, 243, 495, 122, 760; 312/137; 160/351; 40/152, 21, 125 H, 152.1; 211/118, 184

[56] References Cited

UNITED STATES PATENTS

| | | | |
|---|---|---|---|
| 3,296,725 | 1/1967 | Fenwick | 40/125 H |
| 3,322,382 | 5/1967 | Rohrbach | 40/125 H |
| 3,423,894 | 1/1969 | Richardson | 52/282 |
| 3,602,473 | 8/1971 | Van Riet et al. | 52/760 |
| 3,722,122 | 3/1973 | Sesto | 40/152 |
| 3,745,732 | 7/1973 | Pritchard | 52/239 |

*Primary Examiner*—Ernest R. Purser
*Assistant Examiner*—Robert C. Farber
*Attorney, Agent, or Firm*—Johnston, Keil, Thompson & Shurtleff

[57] ABSTRACT

Merchandising display units having a base with one or more pairs of closely spaced cross frame members with opposed, rectangular, vertical grooves in opposing faces thereof forming a vertical socket; a flanged standard-mounting unit fitted tightly over the upper edges of the pair of cross frame members with a rectangular hole above the socket and a depending, U-shaped strap snugly fitted in the socket; and a vertical standard having a lower end of substantially rectangular overall cross section snugly seated in the socket with one pair of opposed sides of the lower end supported by the bottom walls of the grooves and the other pair of opposed sides supported by the vertical legs of the U-shaped bracket.

6 Claims, 3 Drawing Figures

DISPLAY UNITS WITH SOCKET-MOUNTED STANDARDS

Figure 1:
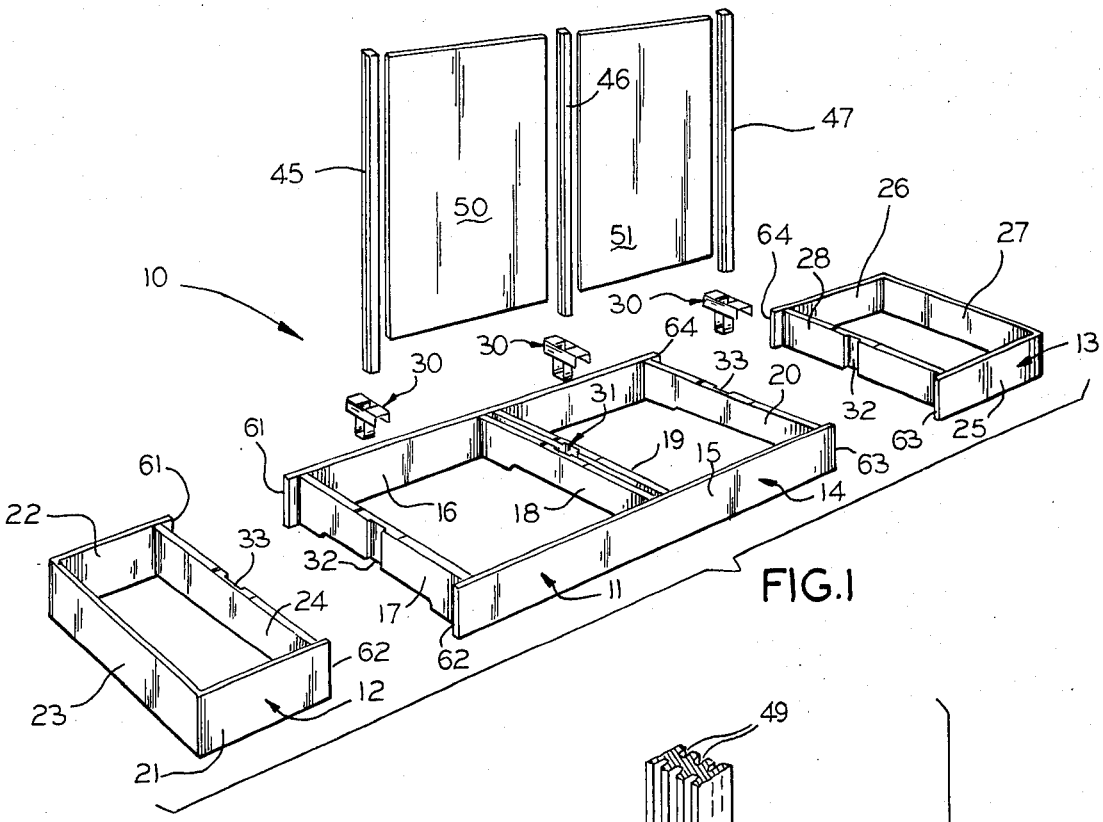

The subject invention pertains to improvements in display units and particularly to improvements in the socket-mounting of vertical standards or posts in the base of such units.

Such merchandising display units utilize two or more vertical standards as supports for vertical divider panels on which merchandise is displayed either by hanging the merchandise on the panels or providing on the panels horizontal shelves for the merchandise. Display units of this type are often moved from time to time to different locations within a store. Additionally, as display needs change, the merchandising display units of the type herein can be made smaller or larger. On other occasions, the merchandising display units are moved temporarily from the display floor to storage, from which they are subsequently returned to the display floor in accordance with the merchandising needs of the store.

Accordingly, merchandisers need merchandising display units of the type herein which can be quickly assembled, disassembled or modified as merchandising needs change. The subject invention provides novel constructions of merchandising display units in which the socket forming members for supporting the lower ends of the vertical standards are formed by a composite of spaced, rectangular grooves provided in opposed faces of two closely spaced cross frame members of the base. The base may be of a single frame construction or it may have a plurality of frame sections which can be attached together in various numbers and arrangements, according to the needs of the merchandiser. The socket-forming, opposed grooves may be in one cross frame member at the end of each of two frame sections, which, when assembled, provide as a composite the closely spaced cross frame members and the socket-forming, opposed, vertical grooves.

A standard-mounting unit is fitted tightly into each socket. This unit is a metal assembly of a plate having two spaced flanges depending from a horizontal cross wall. The horizontal cross wall lies above the socket and on the upper edges of the pair of cross frame members. It has spaced flanges depending from the cross wall, which flanges respectively lie against the outermost sides of said pair of cross frame members to hold them together as a pair unit. The horizontal cross wall has a rectangular hole directly above the socket, which hole corresponds in size to the substantially rectangular, overall transverse cross section of the lower end of a standard to be inserted in the standard-mounting unit through the rectangular hole.

The rectangular hole is positioned substantially midway between the flanges and has two opposite edges at right angles to the flanges. A metal strap member is secured to the bottom side of the horizontal wall. This strap member has two vertical strap legs depending from the horizontal cross wall directly below the respective, aforesaid two opposite edges, the strap legs being at right angles to the flanges. The strap member is seated in the socket with the side edges of the strap legs lying against the respective side walls of the opposed grooves forming the socket. This gives firm support to the strap legs, which in turn firmly support two opposite sides of the lower portion of the standard.

The distance between the bottom walls of the two socket-forming grooves corresponds to the distance between the other pair of opposed sides of the standard whereby the bottom walls of the grooves also firmly support the lower end of the standard against lateral movement within the socket. Thus, the lower end of the vertical standard, which lower end is of substantially rectangular, overall transverse cross section, extends downwardly through the rectangular hole in the horizontal cross wall. One pair of the opposed sides of the lower end of the standard lies against and is snugly supported by the strap legs while the other pair of opposed sides of the lower end lies against and is supported by the bottom walls of the opposed, vertical, socket-forming grooves. The composite standard-receiving socket provided by the bottom walls of the groove and the strap legs keep the standard from tipping under load. The flanges depending from the horizontal cross wall and respectively lying against the outermost sides of the cross frame members keep the cross frame members from spreading in the area adjacent the socket. Preferably, the strap member has a bottom cross strap which connects the lower edges of the strap legs in a position at or above the level of the floor on which the base rests. The bottom of the standard thus rests on and is supported by the cross strap.

The aforedescribed standard-mounting unit may be made of relatively light gauge metal, which has obvious economic advantages. Both the flanged plate and the strap may be made of light gauge steel, e.g., 16 gauge. Depending upon anticipated loads on the standard supported thereby, such gauge may be lighter or heavier, e.g., in the range of 12–20 gauge.

A distinct further advantage of the aforedescribed standard-mounting unit and socket formed by the opposed grooves in the closely spaced cross frame members is that the cross frame members can be made of sheets or boards of wood, particle board or the like. Particle board is made from woodchips bonded together by synthetic resins or polymers to provide relatively inexpensive boards or panels for use in the subject invention when cut to the appropriate dimensions.

Figure 2:
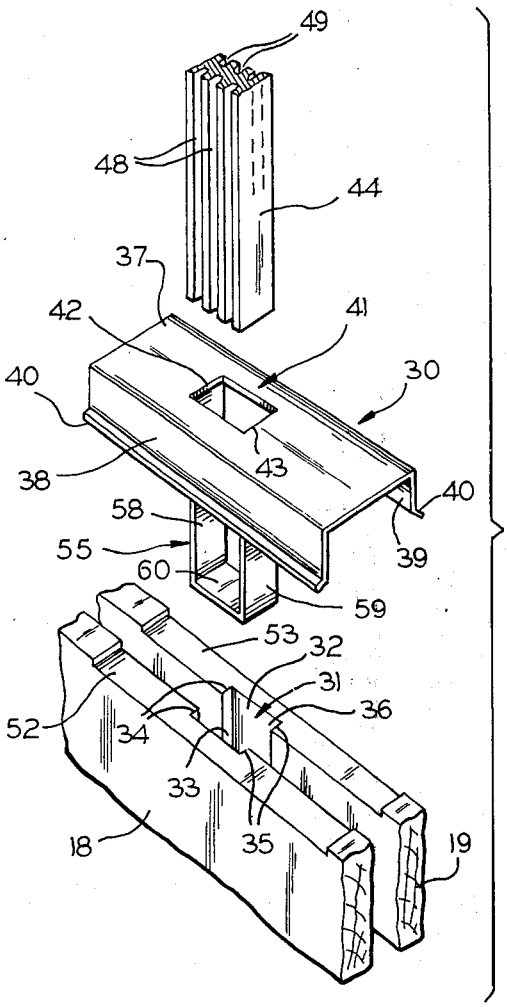
Figure 3:
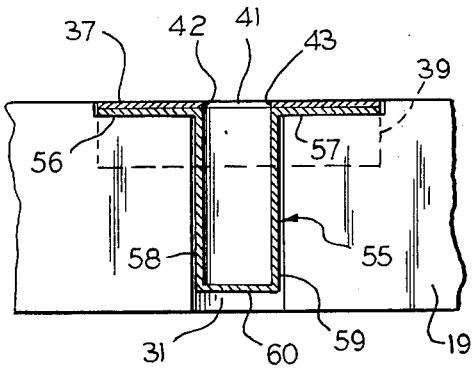

The invention will be further appreciated from the following description of a preferred embodiment of the invention, which is illustrated in the drawing wherein:

FIG. 1 is an exploded, perspective view of a merchandising display unit embodying a base composed of three sections, three vertical standards and two vertical panels supported between the three standards;

FIG. 2 is an exploded, partially fragmentary, perspective view of the lower end of a standard, the metal standard-mounting unit and a pair of closely spaced cross frame members with the vertical, socket-forming grooves therein; and FIG. 3 is a section view taken on a vertical plane between the two closely spaced cross frame members with the standard-mounting unit mounted in the socket-forming, vertical grooves thereof.

Referring to the drawings, merchandising display unit 10 comprises a horizontal base 11 composed of two end sections 12 and 13 and a middle section 14. The latter, rectangular section has longitudinal side walls 15 and 16 connected by cross frame members 17–20. The side walls and cross frame members are made from wooden boards, boards or sheets of particle board or the like and are secured together in any suitable fashion to form the frame of the middle section. The cross frame members 18 and 19 are closely spaced panels or boards extending across the midportion of the middle section 14.

The end section 12 of the base is composed of side walls 21 and 22, an end wall 23, and a cross frame member 24. In the overall assembly, the end section 12 abuts against the middle section 14.

The other end section 13 of the base is composed of the side walls 25 and 26, the end wall 27 and a cross frame member 28. It similarly abuts against the opposite end of the middle section 14 in the overall assembly.

As is the case with the components of the middle section 14, the side walls, end wall and cross frame member of the end sections 12 and 13 may be made of wooden boards, sheets or boards of particle board or the like.

The sections 12–14 thus are open frame sections over which a covering platform is normally laid. Such platform, however, has not been illustrated for purposes of better facilitating illustration of the relevant structures of the subject invention. It will be further appreciated that the horizontal base may be composed of only the middle section 14 and one end section 12 or 13; may be composed of two or more middle sections 14 and one or two end sections 12 and 13; or may be composed of other section assemblies such as a unitary base with one or more middle sections 14 and one or two end sections 12 formed as a single, undivided frame assembly or such as a narrow end section composed essentially of only the cross frame members 24 or 28.

Contiguous, slightly spaced pairs of cross frame members 18,19 and 17,24 and 20,28 have horizontally spaced, opposed faces lying in respective substantially vertical planes. These faces, respectively, contain vertically extending grooves 32,33 of substantially rectangular cross section, each groove having a vertical bottom wall 36 and substantially planar side walls 34,35. Each pair of opposed grooves 32,33 form a vertical socket 31.

A standard-mounting unit 30 is mounted in each socket 31. It is made of a metal plate bent into an inverted U-configuration to provide a horizontal cross plate 37 and depending, substantially vertical side plates or flanges 38,39, each of which may have a flaring, lower longitudinal lip 40. The cross plate 37 has a rectangular hole 41 positioned substantially midway between the side plates or flanges 38,39. Opposed side edges 42,43 of the rectangular hole are substantially at right angles to the side plates or flanges 38,39. The rectangular hole 41 corresponds substantially to the rectangular, overall transverse cross section of the lower end 44 (FIG. 2) of the vertical standards or posts 45, 46 and 47.

Such standards or posts are known and commercially used. In the illustrated embodiment, they comprise hollow metal posts having formed in opposite sides thereof vertical, longitudinal slots 48 and 49. The latter receive and support on the standards divider panels 50 and 51 (FIG. 1), which may be solid panels, pegboard panels or the like.

The standard-mounting units 30 further embody a metal strap 55 bent to provide horizontal strap legs 56 and 57 which are welded or otherwise suitably attached to the underside of the horizontal cross wall 37. The strap 55 further has two, vertical, strap legs 58 and 59 lying directly below the two opposite edges 42 and 43 of the rectangular hole 41. The strap legs 58,59 are at substantially right angles to the flanges 38 and 39. A horizontal cross leg 60 of the strap 55 connects the lower edges of the strap legs 58,59. The lower end of each standard 45–47 rests on the horizontal cross leg 60, which is positioned at a level at or preferably above the floor upon which the horizontal base 11 rests.

The standard-mounting units 30 are inserted in the vertical sockets 31. When so inserted, the strap member 55 is seated in the socket 31 with the side edges of the strap leg lying against the respective side walls 34,35 of the opposed grooves 32,33, i.e., in snug fit in the socket. The width of the strap legs 58,59 is equal to or slightly less than the distance between bottom walls 36,36 of the opposed grooves.

With the standard-mounting units 30 fully inserted, the side plates or flanges 38,39 lie snugly against the outermost sides 64 and 65 of the cross frame boards or sheets 18,19 (or 17,24 or 20,28) to provide firm support against spreading of the cross frame members in the socket areas thereof. Where the cross frame members are components of different sections of the base, e.g., the cross frame pair 17,24 or 20,28, the spacing therebetween is as shown in FIG. 2, which spacing is provided for by setting back the respective cross frame members a slight distance from the abutting ends 61,62 of the side walls of the frame sections 12 and 14 or abutting ends 63,64 of the sections 13 and 14. The frame sections are thus held together by the engagement of the flanges 38,39 against the outermost sides of the cross frame member pairs 17,24 and 20,28.

If desired, however, the end frame sections 12,13 may be held together by other fastening means in addition to the standard-mounting unit 30, e.g., by bolts. Further, if desired, the upper edges of the cross frame members over which the standard-mounting unit 30 is placed may have shallow notches such as notches 52 and 53 (FIG. 2) for the purpose of making the upper surface of the cross plate 37 substantially flush with the upper edges of the cross frame members.

In the overall assembly each standard or post 45–47 is supported in a standard-mounting unit 30 and its corresponding socket 31 in a manner wherein its lower end of substantially rectangular overall cross section, extends downwardly in relatively snug fit through the rectangular hole 41 with one pair of the opposed sides of the lower end of the standard lying against and snugly supported by the strap legs 58,59 and with the other pair of opposed sides of the lower end of the standard lying against and supported by the bottom walls 36 of the opposed grooves 32,33. This socket-mounting plate combination firmly supports the respective standards against tipping or twisting and leads to economies in costs of manufacture of the subject display units. Such economies arise through the possibilities of using, in most cases, relatively light gauge steel for manufacture of the parts of the standard-mounting unit 30 and the utilization of the bottom walls 36 of the opposed grooves 32,33 of the relatively inexpensive cross frame members as part of the overall socket for supporting the standards 45–47.

Further, as shown in FIG. 2, the side 66 (and usually also its opposite side) has vertical slots 67 in which mounting members of shelf supporting brackets may be inserted to provide shelving (not shown) wherever desired on the display unit 10.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the form herein disclosed being a preferred embodiment for the purpose of illustrating the invention.

The invention is hereby claimed as follows:

1. A merchandising display unit comprising a horizontal base with horizontal frame members on opposite sides of the base and connected by a plurality of cross frame members, at least one of said cross frame members being a pair of elongated sheets or boards arranged in a contiguous but horizontally spaced, parallel pair, each pair having horizontally spaced, opposed faces lying in respective substantially vertical planes, a pair of opposed, vertically extending grooves each having a vertical bottom wall and planar vertical side walls in said respective opposed faces to provide a vertical socket, a standard-mounting unit embodying a plate having two spaced flanges depending from a horizontal cross wall, said flanges respectively lying against the outermost sides of respective sheets or boards of said pair to hold said sheets or boards together as a pair unit, said horizontal cross wall having a rectangular hole therein positioned substantially midway between said flanges with two opposite edges of said hole being at right angles to said flanges, a metal strap member secured to said horizontal cross wall, said strap member having two, vertical, flat strap legs respectively directly below said respective two opposite edges, said strap legs being at substantially right angles to said flanges, said strap member being seated in said socket with the side edges of said strap legs lying against the respective side walls of said grooves, and a vertical standard having a lower end of substantially rectangular, overall transverse cross section extending downwardly through said rectangular hole with one pair of opposed sides of said lower end lying against and snugly supported by said strap legs and the other pair of opposed sides lying against and supported by said bottom walls of said opposed grooves.

2. A unit as claimed in claim 1, said strap member embodying a bottom cross strap connecting the lower edges of said strap legs, and the bottom of said standard resting on said cross strap.

3. A unit as claimed in claim 1 wherein said base comprises two base sections with opposing sides, each section having a cross frame member extending along its opposing side, and the latter cross frame members together being said pair of elongated sheets or boards with said vertical socket formed by said opposed vertical grooves, and one of said standard-mounting units mounted on said pair and in said socket in the manner set forth in claim 1.

4. A mounting unit useful in a merchandising display unit having a base with a vertical socket comprising a 12–20 gauge steel plate bent into an inverted U-configuration composed of two spaced elongated flanges depending from a horizontal, elongated, cross wall, said horizontal cross wall having a rectangular hole therein positioned substantially midway between said flanges with two opposite edges of said hole being at right angles to said flanges, a 12–20 gauge steel strap member secured to said horizontal cross wall, said strap member having two, vertical, flat strap legs respectively directly below said respective two opposite edges, said strap legs being at substantially right angles to said flanges and respectively extending vertically downwardly from said cross wall between and below said flanges, said strap member further embodying a bottom cross strap connecting the lower edges of said strap legs, said strap member adapted to be seated snugly in a vertical socket, and said rectangular hole and said strap legs and bottom cross strap further being adapted to snugly receive the lower end of substantially rectangular, overall transverse cross section of a post inserted downwardly through said rectangular hole with one pair of opposed sides of said lower end lying against and snugly supported by said strap legs.

5. A mounting unit as claimed in claim 4, and said flanges each having a lower, flaring, longitudinal lip.

6. A mounting unit as claimed in claim 4, said strap member further having horizontal strap legs extending horizontally from the upper edges of said vertical strap legs away from said rectangular hole, and means attaching said horizontal strap legs to said horizontal cross wall.

* * * * *